US009433818B2

(12) United States Patent
Kalleen

(10) Patent No.: US 9,433,818 B2
(45) Date of Patent: Sep. 6, 2016

(54) ADJUSTABLE MOTION CONTROL ARM PADS FOR BENCH PRESS AND OTHER WEIGHT LIFTING SYSTEMS

(71) Applicant: Patrick E Kalleen, Novato, CA (US)

(72) Inventor: Patrick E Kalleen, Novato, CA (US)

( * ) Notice: Subject to any disclaimer, the term of this patent is extended or adjusted under 35 U.S.C. 154(b) by 85 days.

(21) Appl. No.: 14/620,449

(22) Filed: Feb. 12, 2015

(65) Prior Publication Data

US 2015/0224359 A1 Aug. 13, 2015

Related U.S. Application Data

(60) Provisional application No. 61/938,793, filed on Feb. 12, 2014.

(51) Int. Cl.
*A63B 71/00* (2006.01)

(52) U.S. Cl.
CPC ..... *A63B 21/4029* (2015.10); *A63B 71/0054* (2013.01); *A63B 2071/0063* (2013.01); *A63B 2225/09* (2013.01)

(58) Field of Classification Search
USPC ..... 482/1–148
See application file for complete search history.

(56) References Cited

U.S. PATENT DOCUMENTS 4,411,425 A 10/1983 Milnar
4,531,730 A * 7/1985 Chenera ..... A63B 23/03516 269/17
4,546,967 A * 10/1985 Kecala ..... A63B 21/4031 482/102
5,026,049 A * 6/1991 Goodman ..... A63B 23/0488 482/131
5,125,881 A * 6/1992 Jones ..... A63B 21/0615 482/100
5,472,401 A * 12/1995 Rouillard ..... A63B 23/0233 482/142
5,795,271 A * 8/1998 Pearson ..... A63B 21/0087 482/111
6,508,748 B1 1/2003 Ish
6,659,923 B2 * 12/2003 Teuscher ..... A63B 21/00 482/142
7,361,123 B1 * 4/2008 Krull ..... A63B 21/4029 108/116
7,585,259 B2 9/2009 Turner
7,736,286 B2 * 6/2010 Panaiotov ..... A63B 21/16 482/121
7,837,598 B1 * 11/2010 Boozel, Jr. ..... A63B 21/151 482/38
9,248,337 B1 * 2/2016 Humphrey ..... A63B 21/1457
2013/0203569 A1 * 8/2013 Athis ..... A63B 21/0552 482/142
2015/0224359 A1 * 8/2015 Kalleen ..... A63B 71/0054 482/104

* cited by examiner

*Primary Examiner* — Stephen Crow
(74) *Attorney, Agent, or Firm* — Steven A. Nielsen; www.NielsenPatents.com

(57) ABSTRACT

A bench press system 100 may include an adjustable arm pad support system 300 which may include right and left arm pads, right and left lever arms, right and left radial adjustment brackets and other components. The arm pads may be lowered to accommodate injuries or safety concerns of the user. The radial adjustment brackets may define adjustment voids that will accept a catch pin or link pin of a lever arm. The disclosed configurations allow for one handed adjustment of arm pad positions. The padded arms allow for a tactile warning of arm pad position.

5 Claims, 9 Drawing Sheets

ADJUSTABLE MOTION CONTROL ARM PADS FOR BENCH PRESS AND OTHER WEIGHT LIFTING SYSTEMS

CROSS-REFERENCE TO RELATED APPLICATIONS

This utility patent application claims the priority date, benefit of and contents of patent application 61/938,793 filed on Feb. 12, 2014, the contents of which are incorporated herein by reference.

BACKGROUND OF THE INVENTION (1) Field of the Invention

The invention generally relates to exercise systems. More particularly, the invention relates to means and methods of creating an adjustable motion control system for pressing movements.

(2) Description of the Related Art

The known related art fails to anticipate or disclose the principles of the present invention.

U.S. Pat. No. 4,411,425 "Bench Press Safety Rest" issued to Milnar on Oct. 25, 1983 discloses a support structure positioned adjacent to a bench press bar and above the height of the bench. Milnar may be useful for emergency placement of a bar, but does nothing to restrict the range of motion of a weight lifter.

U.S. Pat. No. 6,508,748 "Actuator Assemblies for Adjustment Mechanisms or Exercise Machines" issued to Ish on Jan. 21, 2003 discloses a radial arm or lift arm having a radial section with interior notches. Ish is helpful in the art of machine type weight lifting systems but fails to address the needs related to limiting the arm and fails to provide arm support.

U.S. Pat. No. 7,585,259 "Weightlifting Spotting Machine" issued to Turner on Sep. 8, 2009 discloses a pair of lateral adjustable bars used to stop or support a bar used upon a bench. But, Turner fails to teach or suggest means or methods of supporting the arms of a person exercising upon a bench.

In the current art, bench exercises, such as bench pressing expose shoulder and elbow components, joint capsules, tendons, ligaments and other vulnerable body parts to undue strain and injury. Due in part to unfettered ranges of motion, bench press injuries are common and well known. Thus, there is a long felt need in the art for the present invention.

BRIEF SUMMARY OF THE INVENTION

The present invention overcomes shortfalls in the related art by presenting an unobvious and unique combination and configuration of methods and components to provide a robust and adjustable system to provide arm support pads perpendicular and hingedly attached to an exercise bench. The disclosed embodiments overcome shortfalls in the art by directly supporting the arms of an exercise bench user and by providing a gentle touch point artfully limiting a range of motion.

Unlike the related art, disclosed embodiments do not touch the bar, but instead provide direct and controlled deceleration of an arm landing upon a disclosed pad. The use of dense foams and other components helps to provide an expanded time of deceleration to avoid injury due to sudden deceleration.

Each arm pad may comprise six exterior sides and may be filled or may comprise foams or other means to decelerate the movement of an arm in a bench press movement.

One of the main benefits to free weight bench pressing is the required balancing of the weight in all directions and the full range of motion offered by a typical bench. For this and other reasons, free weight bench pressing has been popular for decades. The amount of weight an athlete is able to bench press is often used as a bench mark of strength and athletic prowess. Thus, many athletes perform bench press exercises more often and with greater intensity than other less popular exercises. As bench pressing often involves relatively significant amounts of free weight, there is a significant risk of injury or reinjury to almost every involved muscle group and skeletal section.

The invention overcomes shortfalls in the related art by providing a left and right arm support and pad system that integrates into existing exercise benches or may be part of a new construction of an exercise bench. For mechanical efficiency, two lever arms, (right and left) are offset so as to allow the components of both sides to move freely. The offset allows for a more compact configuration while using full sized and full strength components on a normal bench.

The adjustment voids defined within radial arm brackets are configured to create a self-locking system such that arm rests may be positioned with one hand operation.

These and other objects and advantages will be made apparent when considering the following detailed specification when taken in conjunction with the drawings.

REFERENCE NUMERALS IN THE DRAWINGS

Figure 1:
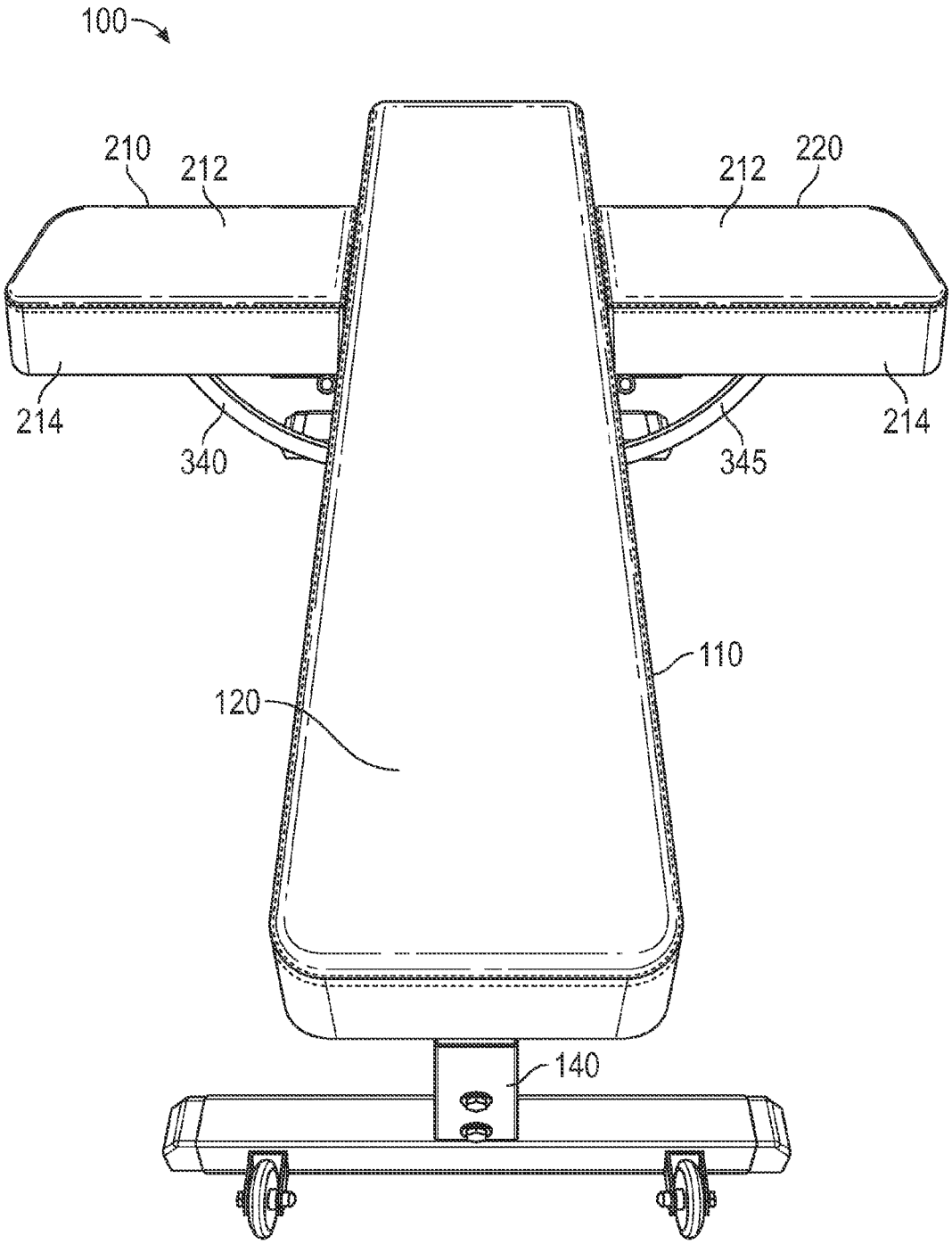
FIG. 1 depicts a top perspective view of a disclosed embodiment

100 a disclosed embodiment in general
110 a bench
120 a top section of a bench
125 a bottom section of a bench
140 support for the foot section of a bench
150 support for a head section of a bench
210 a right arm pad
212 a top surface of an arm pad
214 a side surface of an arm pad
220 a left arm pad
300 an adjustable arm pad support system in general
310 arm pad support plate
315 bench support plate
330 a right lever arm

332 catch pin or link pin retained within a lever arm, 330, 335

335 a left lever arm

337 a first longitudinal member of a lever arm

338 a second longitudinal member of a lever arm

340 a right radial adjustment bracket, sometimes called an adjustment lever

342 adjustment voids defined within a radial adjustment bracket

345 a left radial adjustment bracket, sometimes called an adjustment lever

347 radial adjustment bracket with an alternative pattern of adjustment voids

350 a right hinge

355 a left hinge

356, a first planar member of a hinge, attached to bench

357 a second planar member of a hinge, attached to an arm pad or arm pad support plate

360 a right anchor

365 a left anchor

370 a right pivot assembly attached to the right anchor 360

375 a left pivot assembly attached to the left anchor 365

400 offset line of right arm lever

405 offset line of left arm lever

415 distance or offset between a right and left arm lever

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts a disclosed system 100 with right arm pad 210 and a left arm pad 220 in a level position or at zero degrees. A system may further comprise a bench 110 with the bench having a top side 120. A right radial adjustment bracket 340 is shown to be offset from a left radial adjustment bracket 345. A foot support system 140 is shown in the foreground. An arm pad may comprise six sides which may include a topside 212, four sides 214 and a bottom side. Within the six sides of an arm pad, an arm pad may be filled or may comprise foam or other material suitable to decelerate an arm pressing into the pad. The use of arm pads presents a new and novel approach to providing a gentle deceleration and safety stop in free weight bench pressing.

Arm pads may be positioned such that a system user is prevented from moving their lower arms past a predefined set point.

Figure 2:
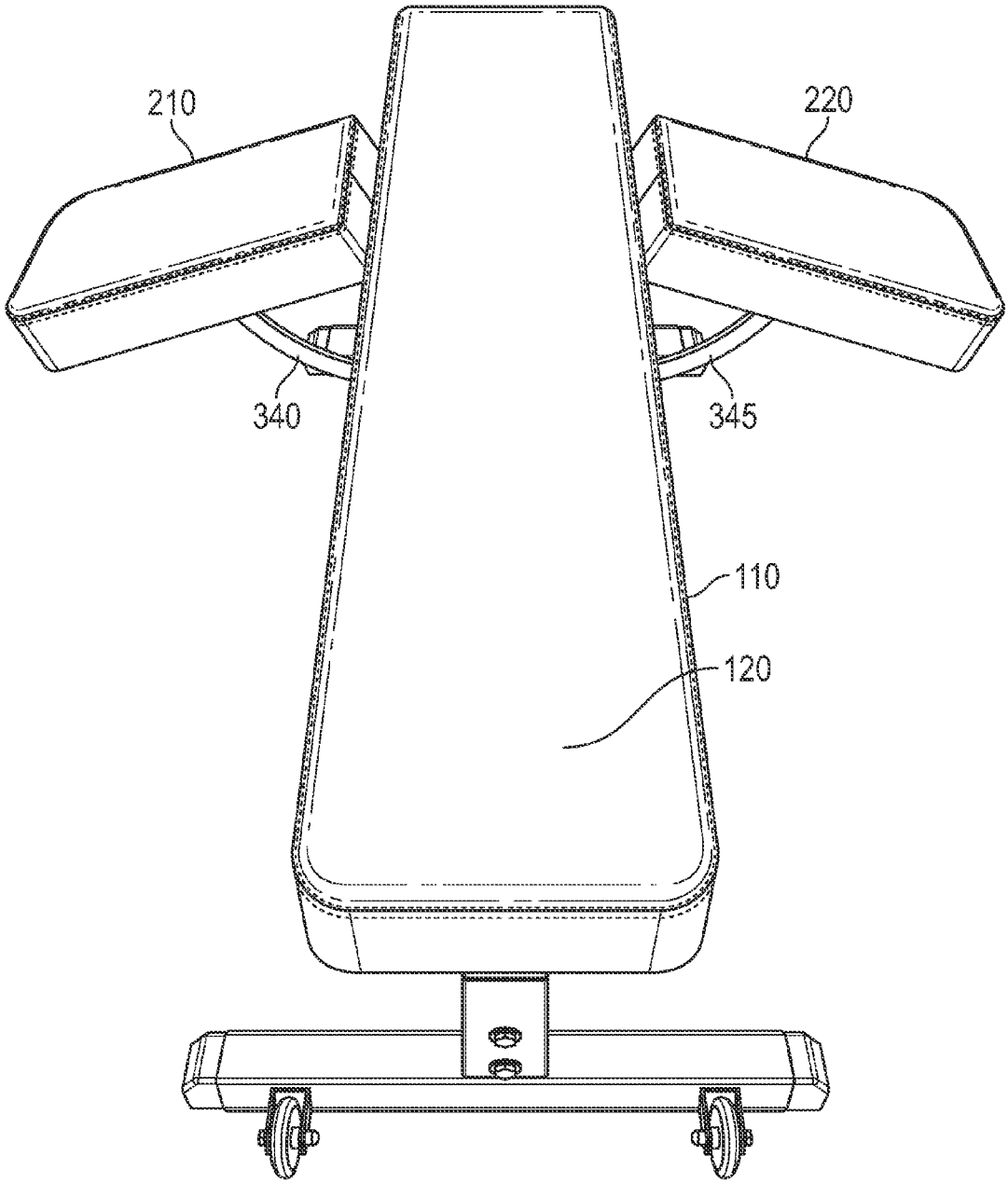
FIG. 2 depicts a top perspective view of a disclosed embodiment

FIG. 2 depicts a bench 110 with a right arm pad 210 and a left arm pad 220 at an angle to support the arms of a user of the system. The first disclosed angle is approximately 7.5 to 15 degrees. The first disclosed angle allows for bench pressing with the elbows (and/or lower arms) moving slightly past the planar surface of the bench 110. Other decline positions are possible with the disclosed system and are in the range of 7.5 degrees and greater.

Figure 3:
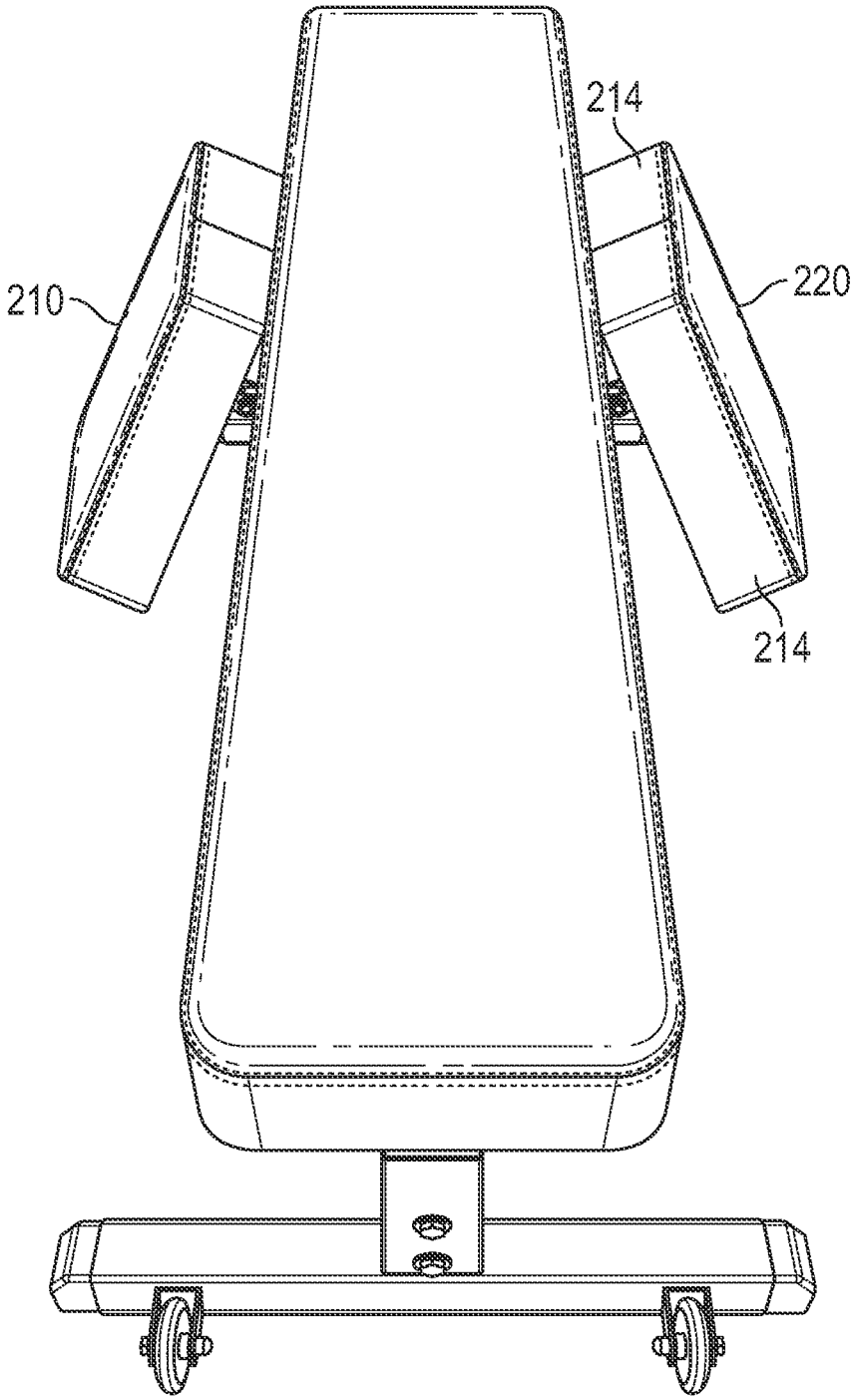
FIG. 3 depicts a top perspective view of a disclosed embodiment

FIG. 3 depicts a bench with a right arm pad 210 and a left arm 220 in a down position to all a user of the system full arm movement. In this position, a user may perform bench press movements in a traditional manner, without restriction. FIG. 3 depicts a plurality of side sections 214 of arm pads 210 and 220.

Figure 4:
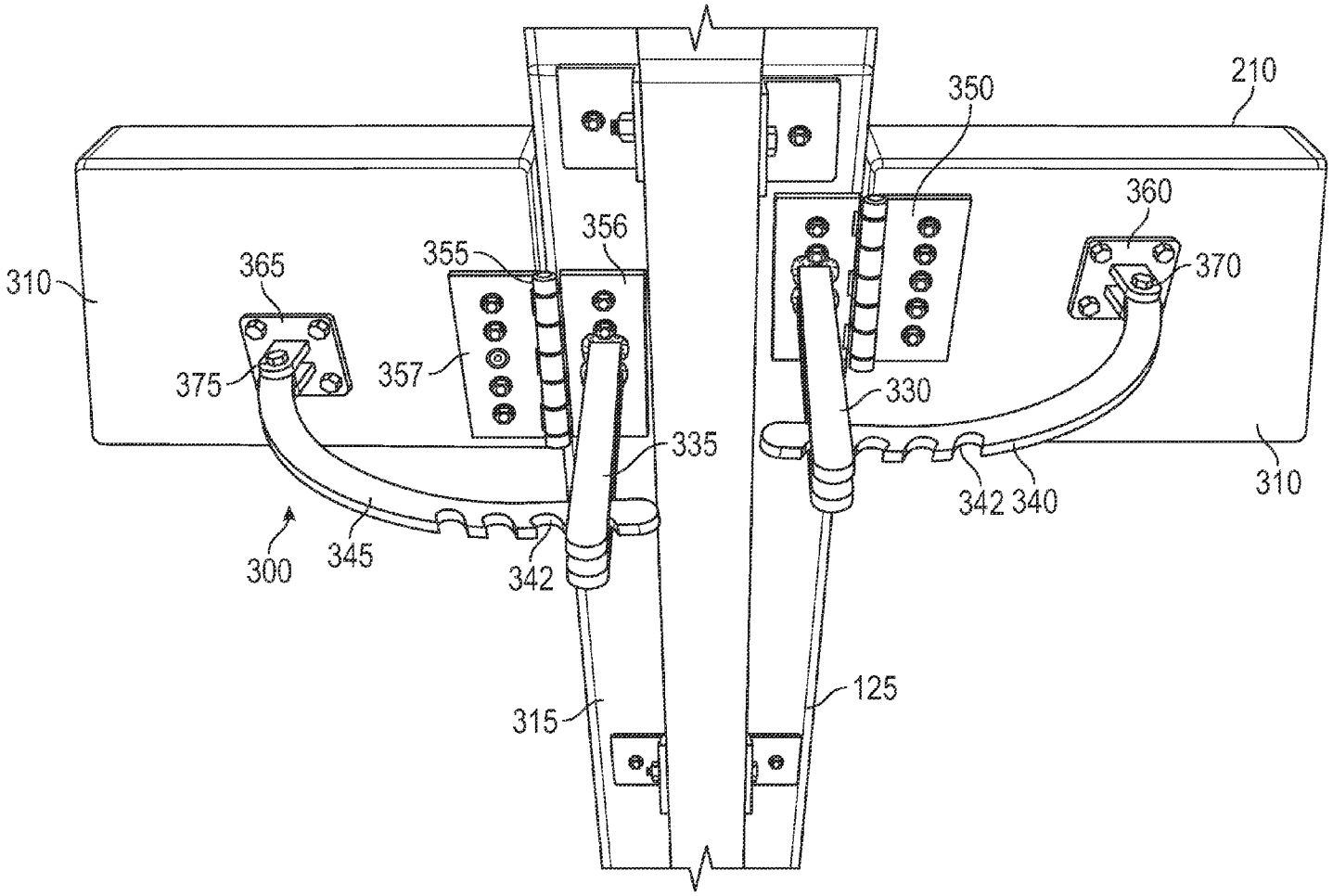
FIG. 4 depicts a bottom perspective view of a disclosed embodiment

FIG. 4 depicts various components found on the bottom side of a disclosed system. The system may include an adjustable arm pad support system 300 which may comprise a lever arms 330, 335 attached to a bench or bench support plate 315; an arm pad and bench attached by use of a hinge 350 or pivotal attachment system; a lever arm 330, 335 adjustably attached to radial adjustment bracket, 340, 345, with the radial adjustment bracket attached to an arm pad or arm pad support plate 310 by use of a pivot assembly 370, 375 and anchor 360, 365.

A right lever arm 330 and a left lever arm 335 may comprise two longitudinal members with an internal link pin (not shown) with the link pin comporting to the adjustment voids 342 defined within a radial adjustment bracket 340, 345.

Each hinge 350, 355 may comprise a first planar member 356 attached to a bench or bench support plate 315 and a second planar member 357 attached to an arm pad or arm pad support plate 310. Each hinge may allow an arm pad to be pivotally connected to the bench. The supported angle of each arm pad is secured by the voids 342 of a radial adjustment bracket 340, 345 being filled by a link pin of a lever arm 330, 335.

Figure 5:
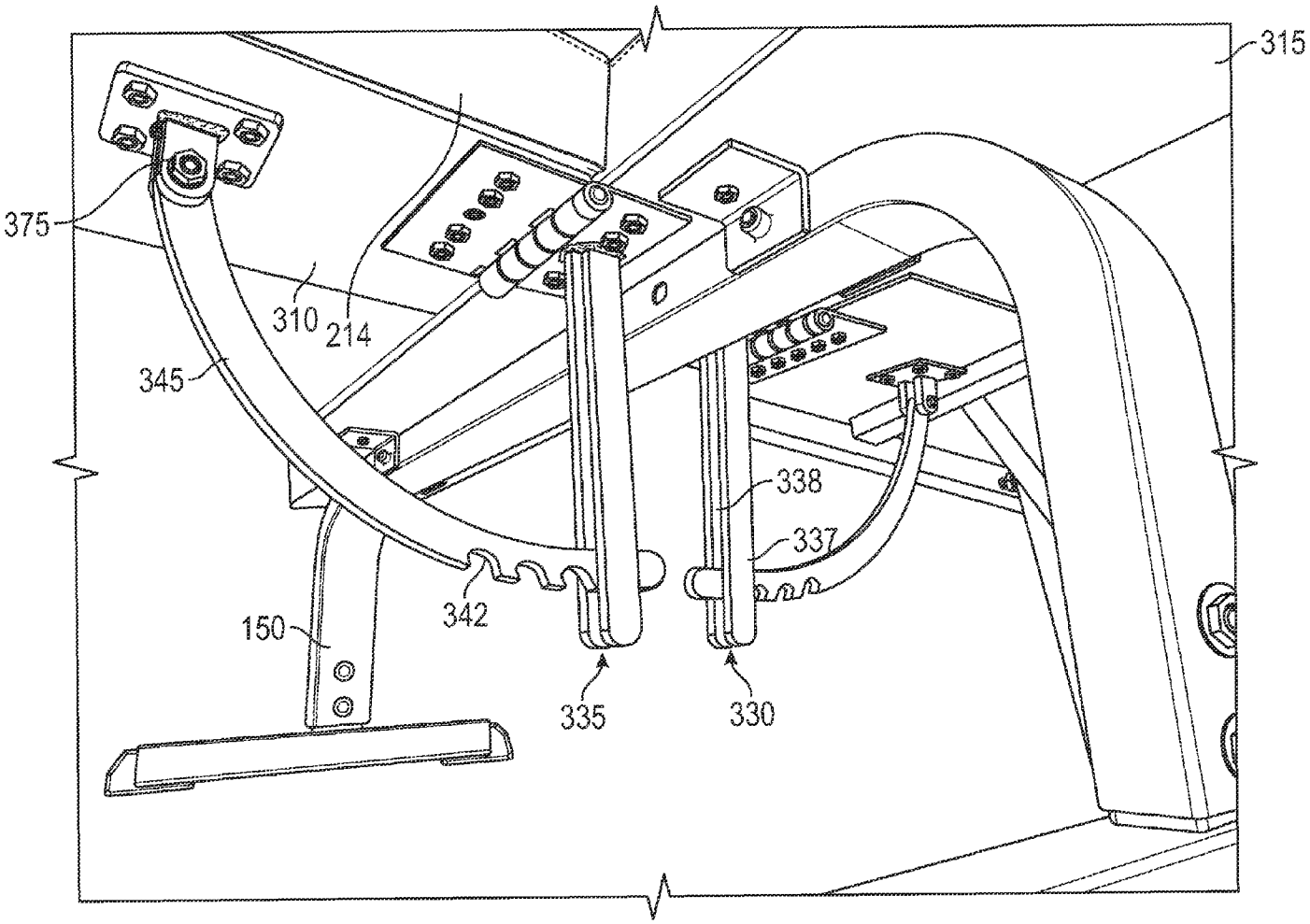
FIG. 5 depicts a right and bottom perspective view of a disclosed embodiment

FIG. 5 depicts an alternative view of FIG. 4 and further depicts a support 150 for a head section of the bench. Each lever arm, 330, 335 may comprise a first longitudinal member 337 and a second longitudinal member 338. A catch pin or link pin may be retained between the first and second longitudinal members. The catch pin or link pin may fit or comport to the adjustment voids 342 defined within the radial adjustment brackets.

Figure 6:
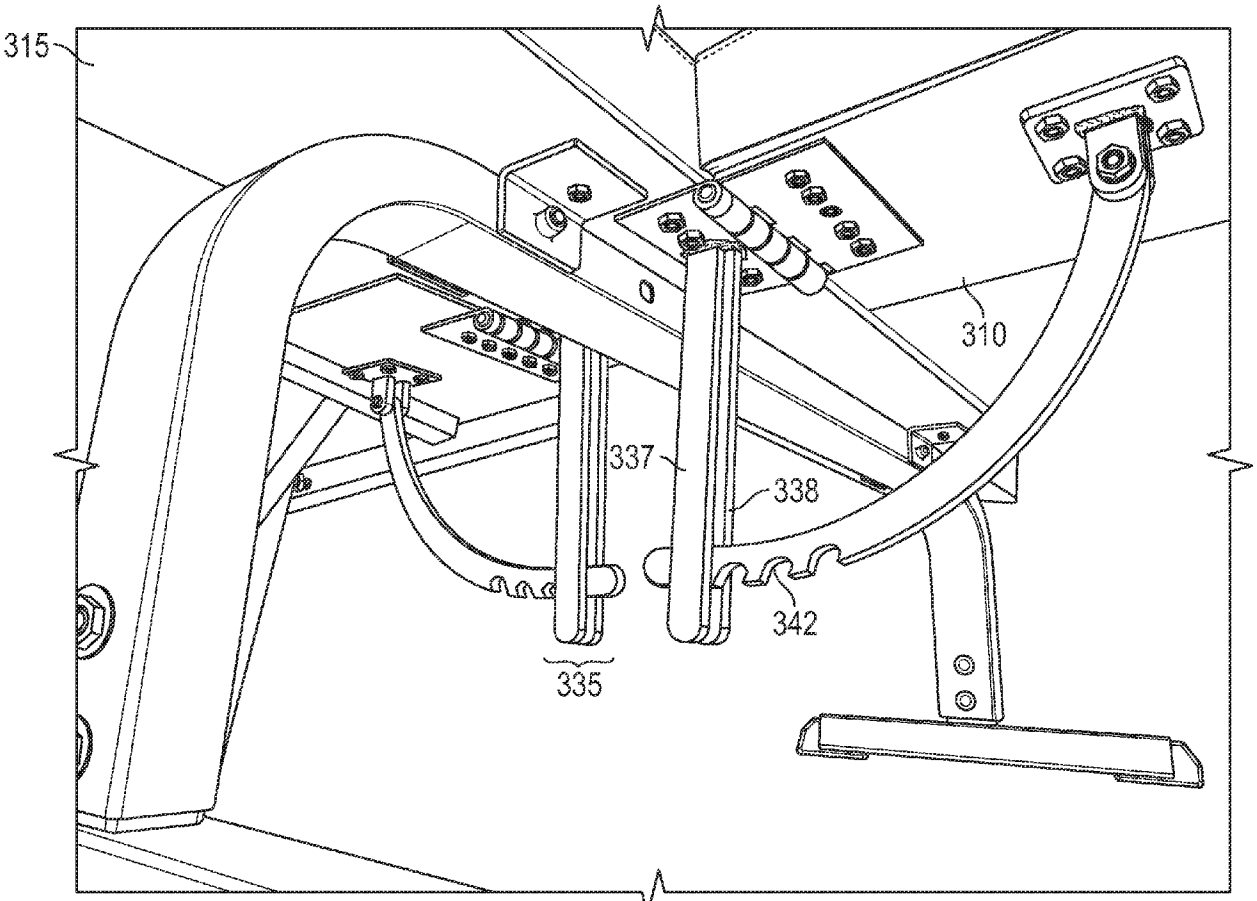
FIG. 6 depicts a left and bottom perspective view of a disclosed embodiment

FIG. 6 depicts a disclosed system with pads in a fully lifted position.

Figure 7:
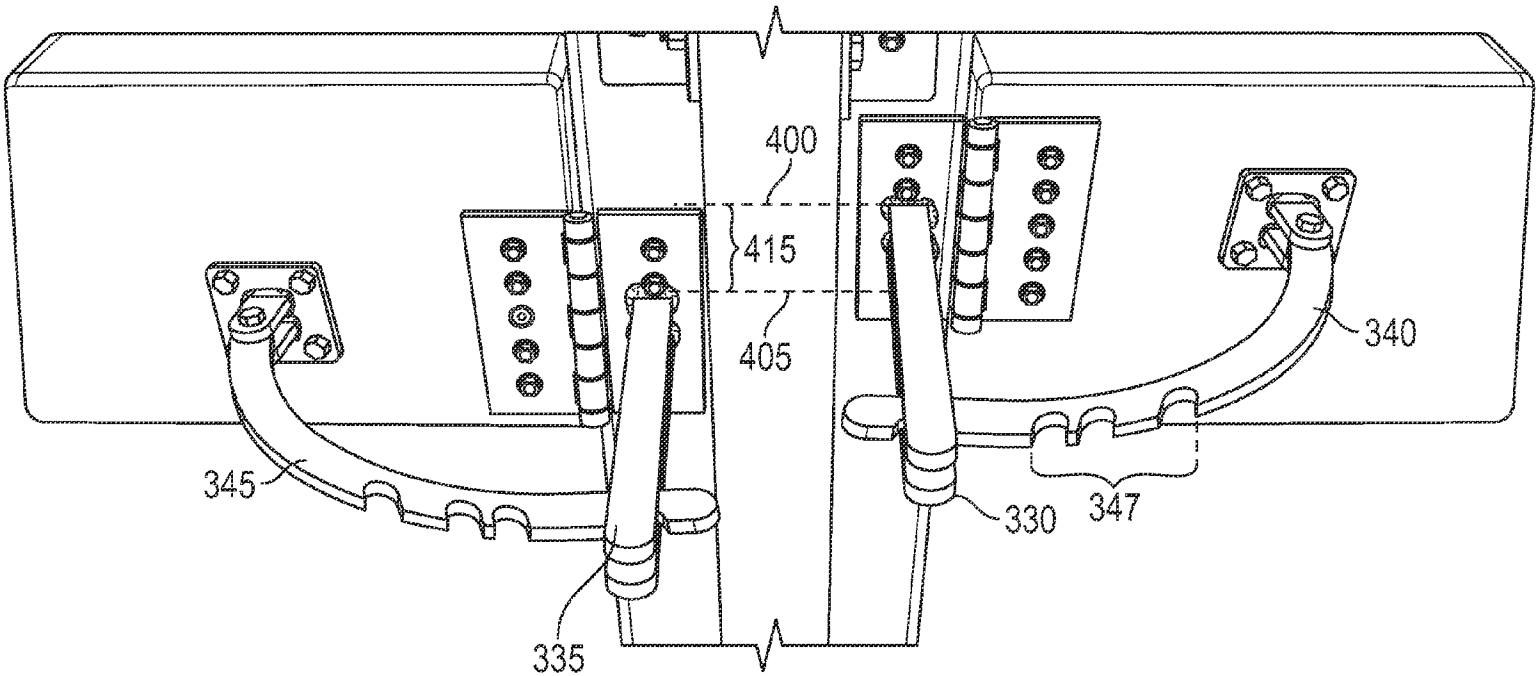
FIG. 7 depicts a bottom perspective view of a disclosed embodiment

FIG. 7 highlights the offsets between the right arm lever 330 and the left arm lever 335. The first offset line 400 of the right arm lever is apart from the second offset line 405 of the left arm lever 335. An offset distance 415 is depicted between the space defined between the first and second off set lines. The offset space 415 provides a mechanical advantage as larger and more robust components, lever arms 330, 335 and radial adjustment brackets 340, 345 may be used in closer proximity, without scaling down su FIG. 7 also depicts an alternative pattern 347 in the adjustment voids 342 of a radial adjustment bracket. Various angles between the bench and arm pads are contemplated. The angles shown herein do not limit the scope of this disclosure.

Figure 8:
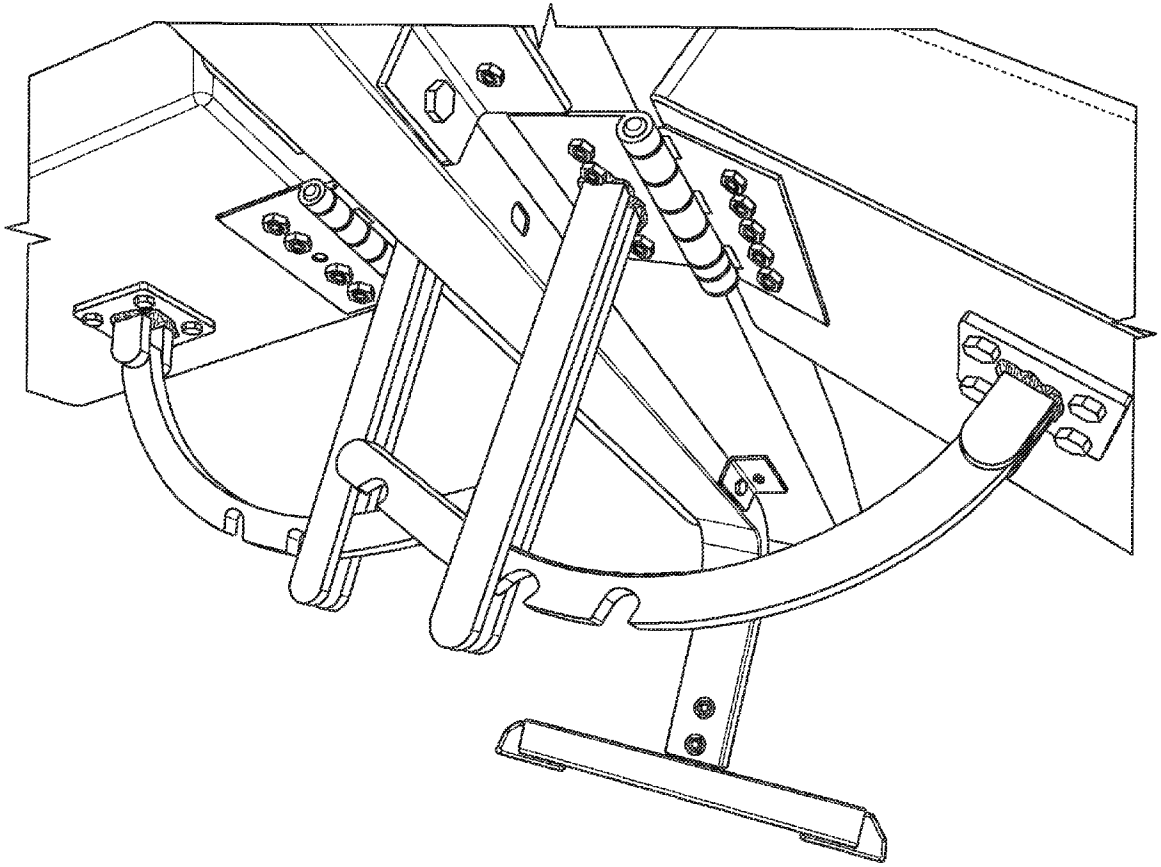
FIG. 8 depicts a bottom perspective view of a disclosed embodiment

FIG. 8 depicts the offset nature of the two adjustment levers or radial adjustment brackets. The two brackets cross planes but do not collide or block one another.

Figure 9:
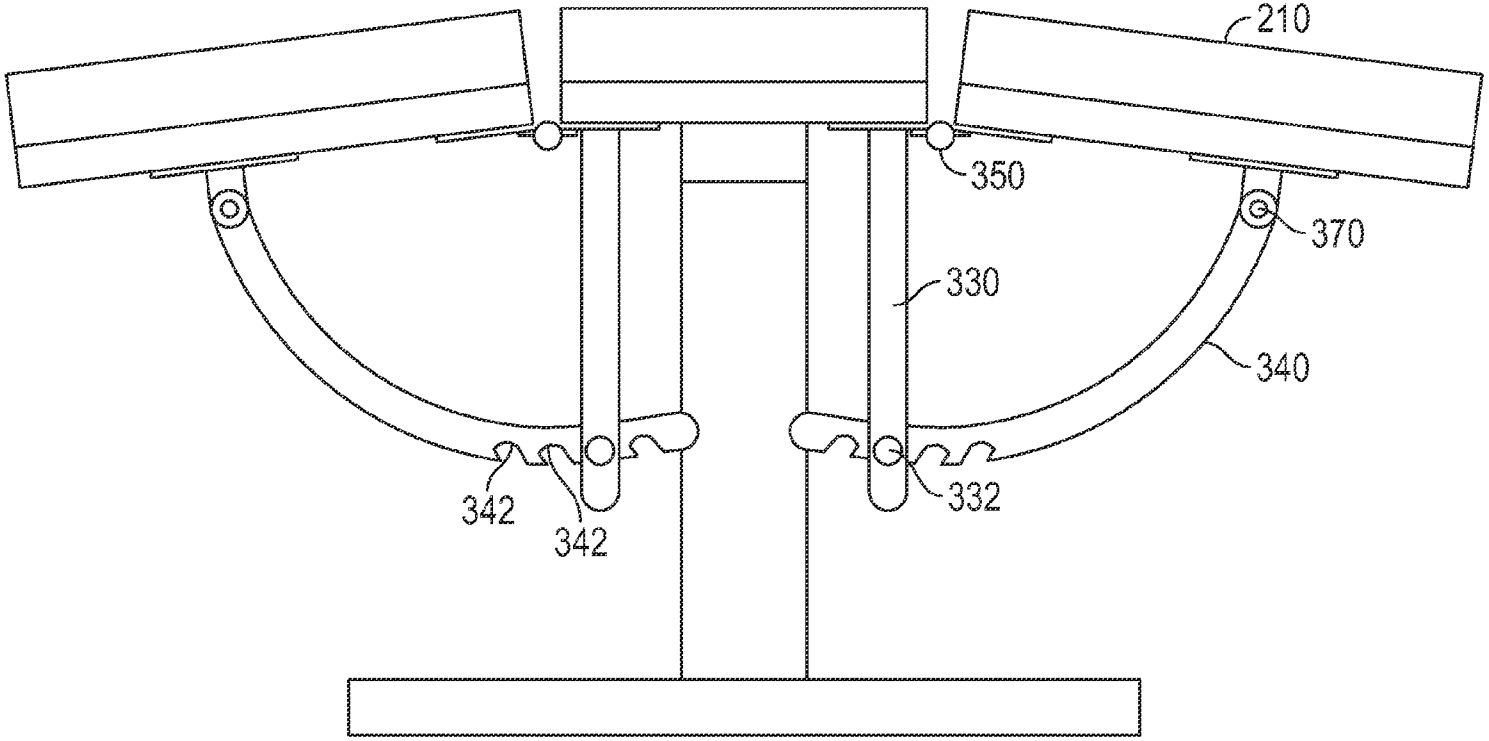
FIG. 9 depicts an elevation view of a disclosed embodiment

FIG. 9 depicts a catch pin 332 or link pin securing a right lever arm 330 into an adjustment void of a right radial adjustment bracket 340. The adjustment voids 342 are configured to accept a catch pin with one handed operation. The radial adjustment brackets may be equipped with adjustment knobs or handles to facilitate the repositioning of the arm pads.

Foam material within the six sides of the arm pads may provide tactile warning of the positions of the adjustable arm pads. This feature overcomes shortfalls in the related art as an end user may slow down their lifting movement to avoid an abrupt stop upon the adjustable arm pads.

Items.

Disclosed embodiments may include the following items.

1. A bench press system with adjustable arm pads, the system comprising:

a) a bench having a top side and a bottom side;

b) the bench hingedly attached to a first arm pad and a second arm pad;

c) the first and second arm pads comprising a top surface, a bottom surface and four side surfaces, with the first and second arm pads comprising a flexible and resilient material;

d) a first and second lever arm attached to the bottom side of the bench with each lever arm comprising a catch pin e) a radial adjustment bracket attached to each arm pad;

f) each radial adjustment bracket defining a plurality of adjustment voids, with each adjustment void configured to comport with the catch pin of the arm lever;

2. The system of 1 wherein each hinge attachment of the bench to the two arm pads comprises a first member attached to the bench and a second member attached an arm pad, 3. The system of 2 wherein each radial adjustment bracket is attached to the bottom side of its respective arm pad with an anchor and pivot assembly.

4. The system of 3 wherein the respective attachments points of the lever arms and radial adjustment brackets are off set.

What is claimed is:

1. A bench press system with adjustable arm pads, the system comprising:

a) a bench having a top side, a bottom side, a longitudinal length, and lateral sides;

b) the bench hingedly attached at the lateral sides to a first arm pad and a second arm pad;

c) the first and second arm pads comprising a top surface, a bottom surface and four side surfaces, with the first and second arm pads comprising a flexible and resilient material;

d) a first and second lever arm attached to the bottom side of the bench with each lever arm comprising a catch pin;

e) a radial adjustment bracket attached to each arm pad; and f) each radial adjustment bracket defining a plurality of adjustment voids, with each adjustment void configured to comport with the catch pin of the arm lever.

2. The system of claim 1 wherein each hinge attachment of the bench to the two arm pads comprises a first member attached to the bench and a second member attached to an arm pad.

3. The system of claim 2 wherein each radial adjustment bracket is attached to the bottom side of its respective arm pad with an anchor and pivot assembly.

4. The system of claim 3 wherein the respective attachments points of the lever arms and radial adjustment brackets are off set.

5. The system of claim 4 wherein each lever arm comprises a first longitudinal member and a second longitudinal member with the catch pin secured between the first and second longitudinal members.

* * * * *